US007516864B2

(12) United States Patent
Chen et al.

(10) Patent No.: US 7,516,864 B2
(45) Date of Patent: Apr. 14, 2009

(54) BUILT-UP CONTAINER

(75) Inventors: Kung-Cheng Chen, Taichung Hsien (TW); Lung-Chuan Huang, Taichung Hsien (TW)

(73) Assignee: E-MAKE Co., Ltd. (TW)

( * ) Notice: Subject to any disclaimer, the term of this patent is extended or adjusted under 35 U.S.C. 154(b) by 712 days.

(21) Appl. No.: 11/171,056

(22) Filed: Jun. 30, 2005

(65) Prior Publication Data

US 2007/0000923 A1 Jan. 4, 2007

(51) Int. Cl.
*B65D 6/24* (2006.01)

(52) U.S. Cl. ..... 220/4.33

(58) Field of Classification Search ..... None
See application file for complete search history.

(56) References Cited

U.S. PATENT DOCUMENTS 5,762,222 A * 6/1998 Liu ..... 220/1.5

* cited by examiner

*Primary Examiner*—Stephen Castellano
(74) *Attorney, Agent, or Firm*—Connolly Bove Lodge & Hutz

(57) ABSTRACT

A built-up container includes a base, a front and rear side plates, a right and left side plates and a lifted upper cover. The base provides threaded holes and the side plates provide through holes and threaded holes so that the container can be built up with bolts engaging with the threaded holes. It is characterized in that no holes and no bolts expose outside the container with reinforced strength such that integrity and smoothness of the container can be obtained and the fasteners inside the container are free from water and unable to hurt foreign objects. In addition, the container is capable of being set up fast easily to enhance facility of assembling job.

1 Claim, 7 Drawing Sheets

BUILT-UP CONTAINER

BACKGROUND OF THE INVENTION

1. Field of the Invention:

The present invention is related to a built-up container and particularly to a reinforced container set up by means of conceal type screw threaded connection with which integrity and smoothness of appearance thereof can be obtained, bolts being free from water and away hurting foreign objects can be assured and assembling speed can be promoted effectively.

2. Brief Description of the Related Art:

The conventional various built-up containers normally provide a construction, as shown in FIG. 1, basically including a base 2 and a front, rear, right and left side plates 4. The base 2 has a plurality of threaded holes 3 next to the sides thereof. The side plates 4 are vertically disposed on the base 2 with a joining part 6 bent inward at the lower end thereof respectively. The joining part 6 and both sides of each side plate provide a plurality of through holes 5 equally spacing apart from each other. Hence, the side plates 4 can be fixedly attached to the base 2 by means of bolts 9 engaging with the threaded holes 3 via the through holes 5.

Further, a plurality of L shaped angle plates 7, which have a plurality of through holes 8 spacing apart an equal distance from each other, are vertically disposed at all corners of the base 2 and the through holes 8 correspond to the through holes 5 at the side plates 4 respectively so that the angle plates 7 are fixedly attached to the side plates 4 with bolts 9 passing through the through holes 4, 8 and engaging with a nut.

It can be found the bolts 9 expose outside the side plates 4 but they are easy being rusty due to water or moisture and it creates potential dangerous parts to hurt people next to them or tumble articles passing by. Further, integrity and smoothness of appearance of the container is defected with the bolts 9 and the angle plates 7. In addition, it is very tedious to set up the container.

SUMMARY OF THE INVENTION

An object of the present invention is to provide a built-up container, in which the through holes and the bolts are conceal inside the container to enhance integrity and smoothness of appearance thereof and to assure bolts being free from water and unable to hurt foreign objects with promoted assembling speed effectively.

Accordingly, the built-up container according to the present invention includes a base, a front and rear side plates, a right and left side plates and a lifted upper cover. The base provides threaded holes and the side plates provide through holes and threaded holes for the container capable of being built up with bolts engaging with the threaded holes. It is characterized in that no holes and no bolts expose outside the container with reinforced strength such that integrity and smoothness of the container can be obtained and the fasteners inside the container are free from water and unable to hurt foreign objects. In addition, the container is capable of being set up fast easily to enhance facility of assembling job.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
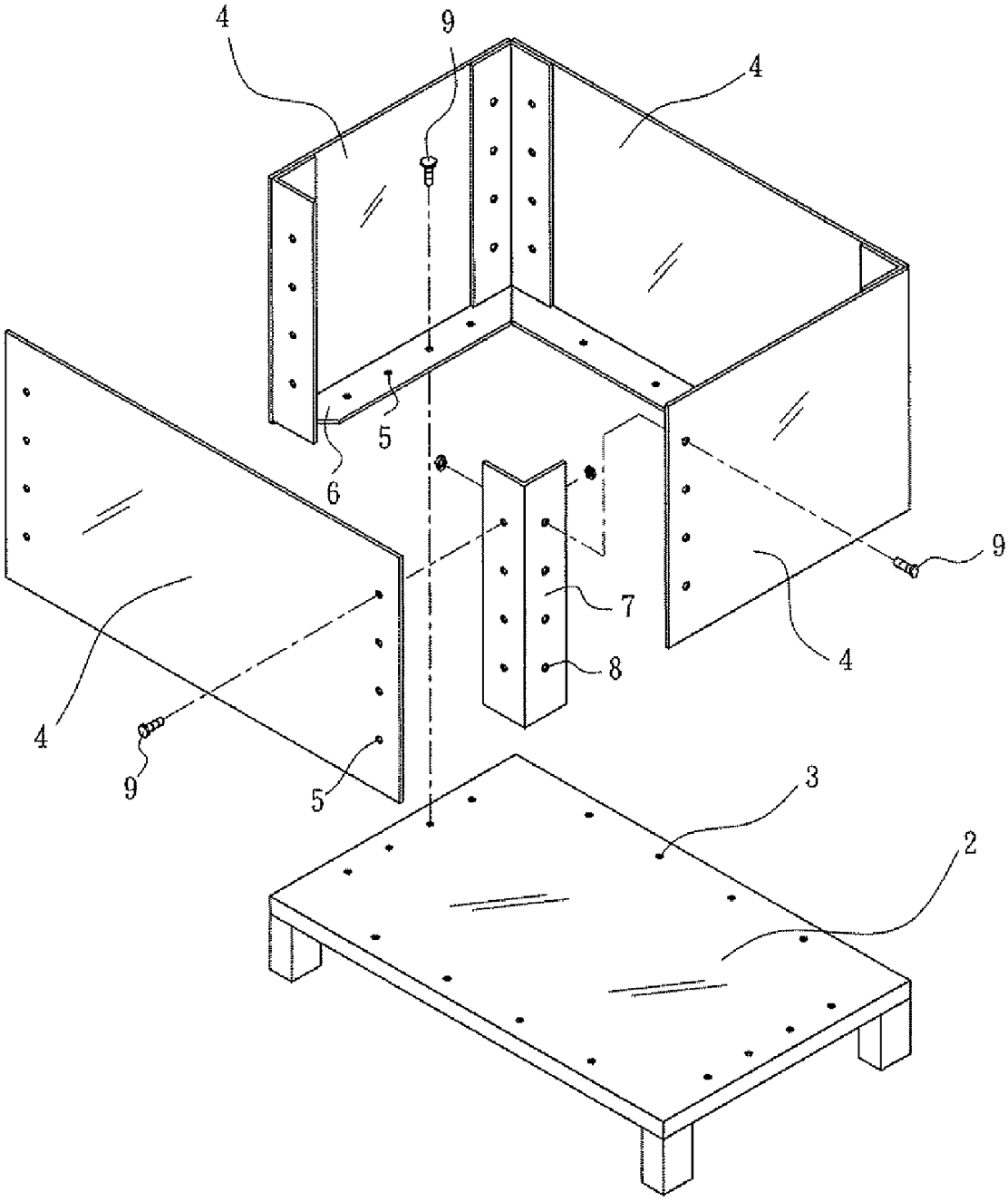
FIG.1 Prior Art
FIG. 1 is a perspective view of conventional container for tools.
Figure 2:
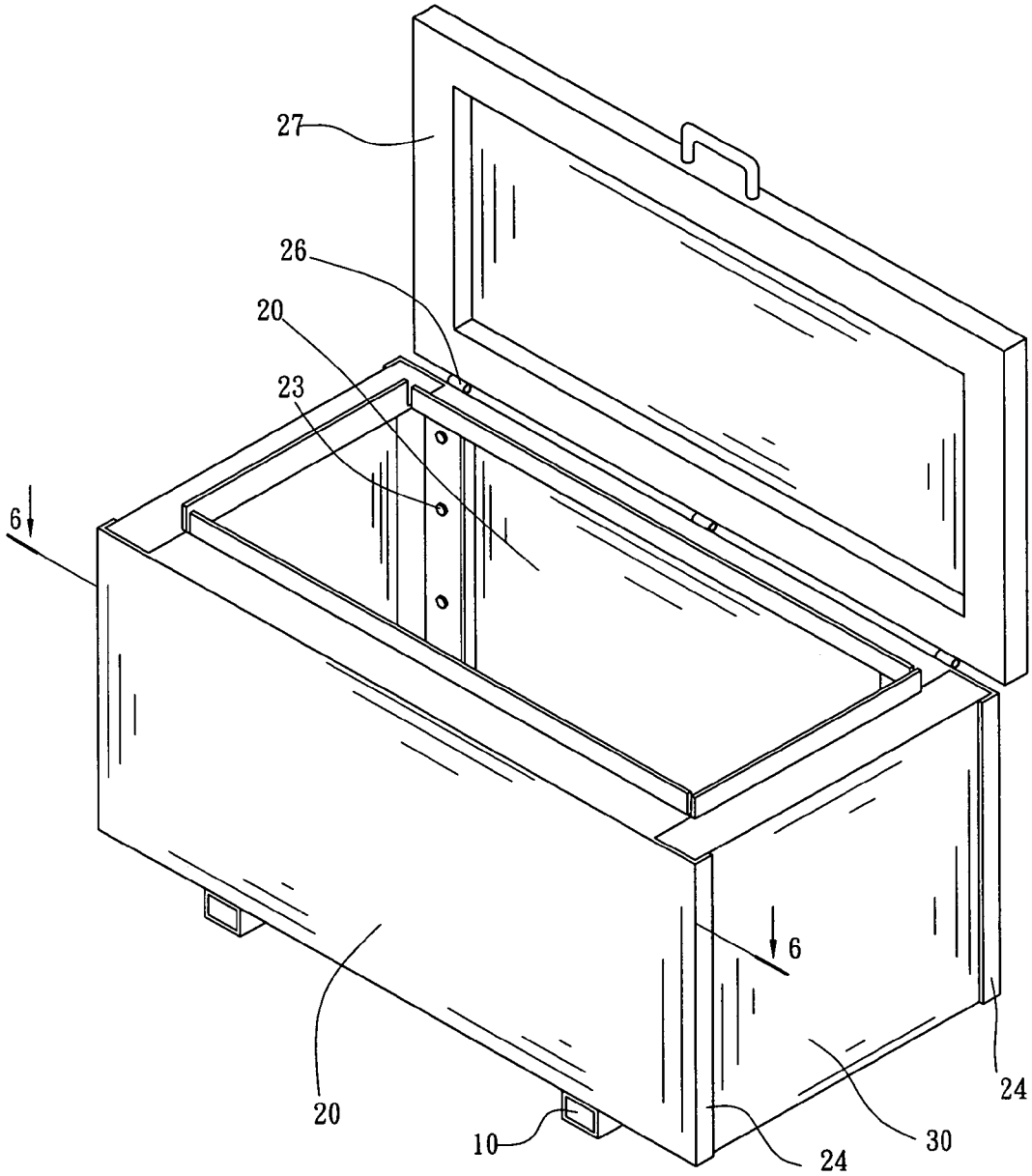
FIG. 2 is a perspective view of the first embodiment of a built-up container according to the present invention.
Figure 3:
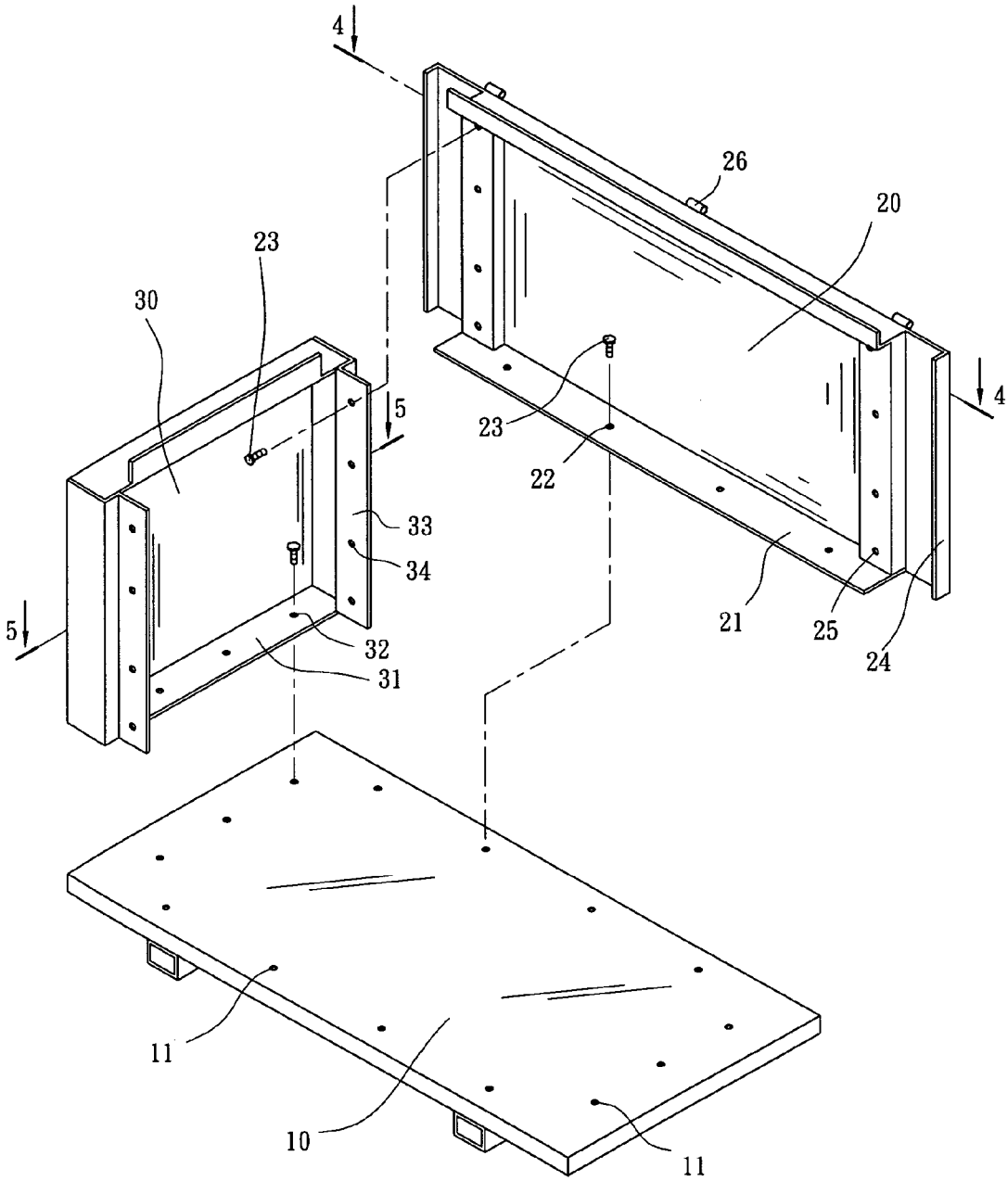
FIG. 3 is an exploded perspective view of part of the first embodiment according to the present invention.
Figure 4:
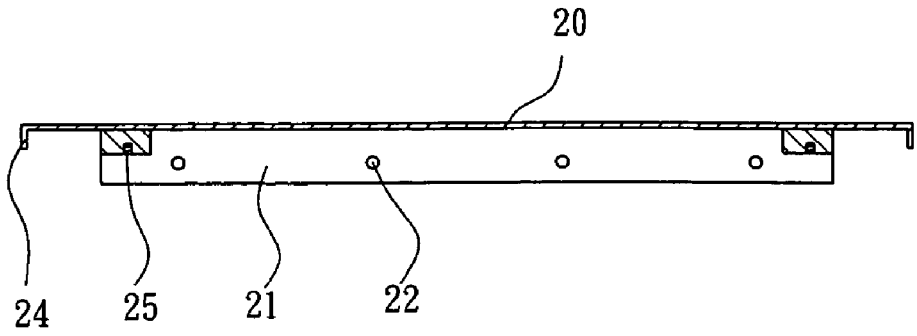
FIG. 4 is a sectional view along line 4-4 shown in FIG. 3.
Figure 5:
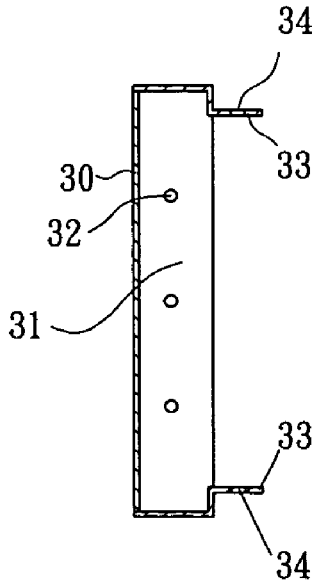
FIG. 5 is a sectional view along line 5-5 shown in FIG. 3.
Figure 6:
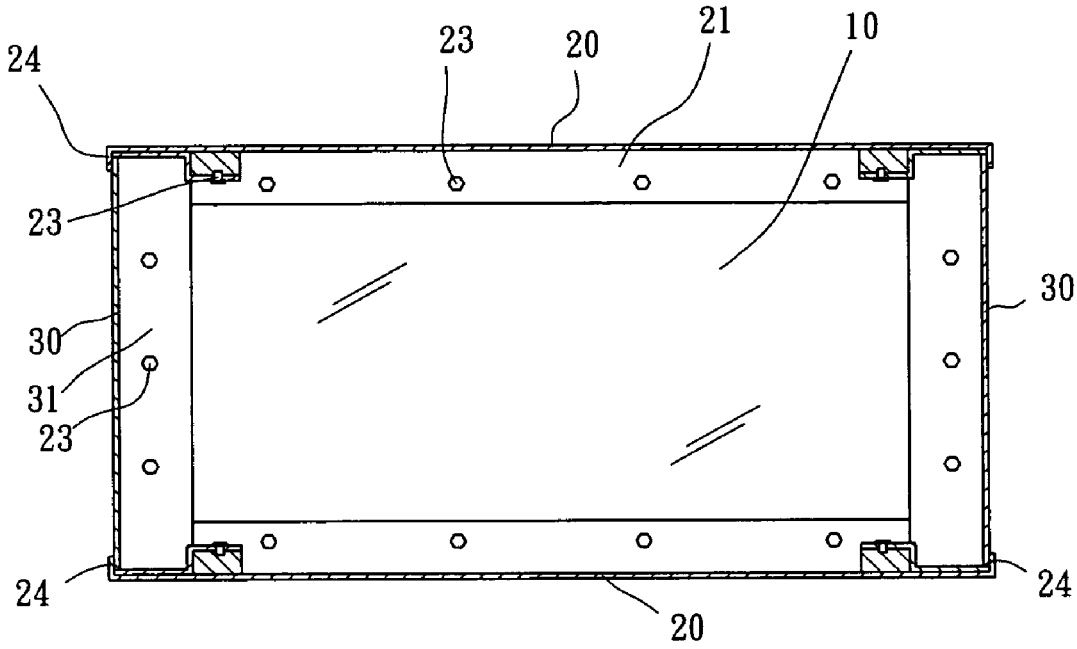
FIG. 6 is a sectional view along line 6-6 shown in FIG. 2.

Referring to FIGS. 2 to 6, the built-up container of the present invention includes the following parts.

A base 10, which provides a plurality of threaded holes 11 spacing from each other around the edges thereof.

A front and rear side plates 20, which are vertically disposed at the front side and rear side of the base 10. Each of the front and rear side plates 20 has a lower joining part 21 bent inward with a plurality of equally spaced through holes 22 corresponding to the threaded holes 11 for being passed through with bolts 23. The bolts 23 further engage with the threaded holes 11 such that the front and rear side plates 20 are capable of being fixedly detached to the base 10. Besides, each of the front and rear side plates 20 has a lip part 24 bent inward at two lateral sides respectively and a plurality of threaded holes 25 are lined up vertically next to the lip part 24.

A right and left side plates 30, which are vertically disposed at the right side and left side of the base 10. Each of the left and right side plates 30 has a lower joining part 31 bent inward with a plurality of equally spaced through holes 32 corresponding to the threaded holes 11 for being passed through with bolts 23. The bolts 23 further engage with the threaded holes 11 such that the right and left side plates 30 are capable of being fixedly detached to the base 10. Besides, each of the right and left side plates 30 has a lateral joining part 33 bent inward at two lateral sides respectively and a plurality of through holes 34 are lined up vertically at the lateral joining part 33 corresponding to the threaded holes 25 at the front and rear side plates 20 such that the bolts 23 can engage with the threaded holes 25 via the through holes 34 to allow the right and left side plates 30 fixedly attached to the front and rear side plates 20.

In addition, a plurality of hinges 26 are attached to one of the front and rear side plates 20 or one of the right and left side plates 30 such that an upper cover plate 27 can be movably attached to the hinges 26.

Figure 7:
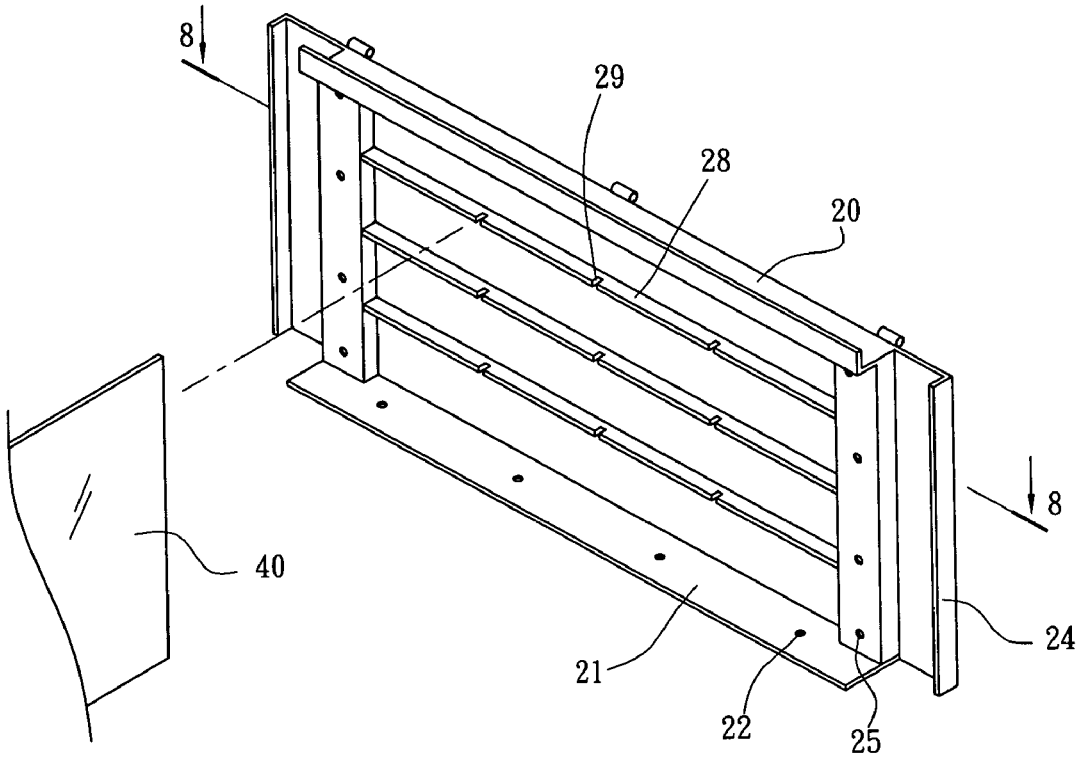
FIG. 7 is an exploded perspective view of part of the second embodiment according to the present invention.
Figure 8:
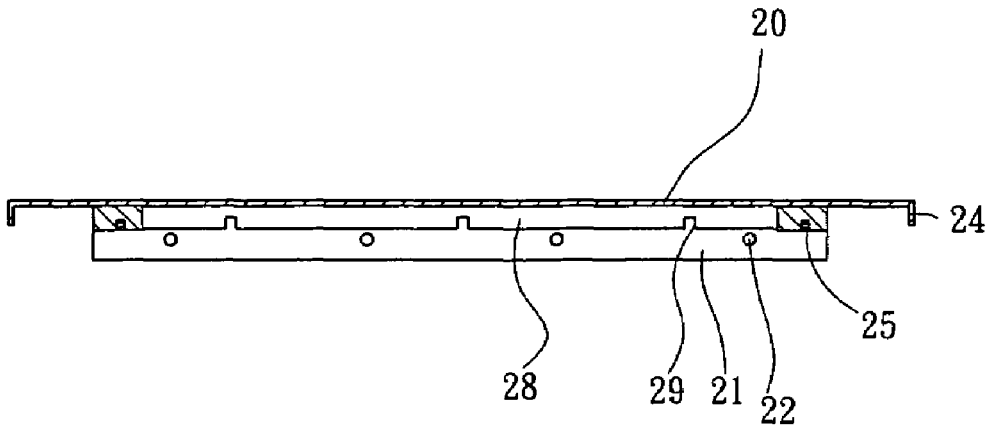
FIG. 8 is a sectional view along line 8-8 shown in FIG. 7.
Figure 9:
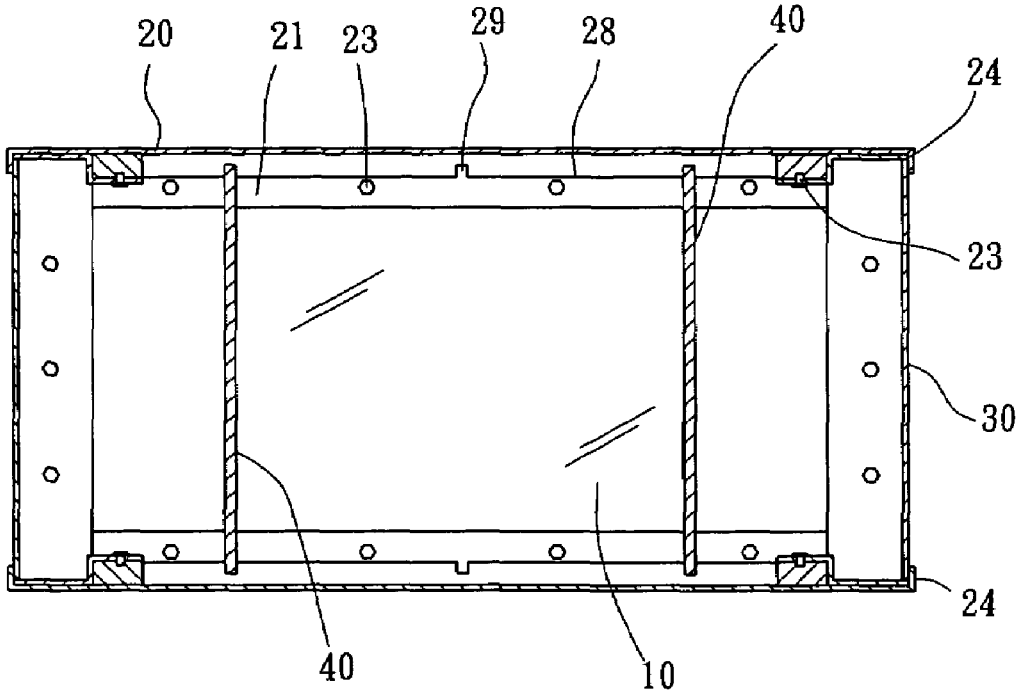
FIG. 9 is a sectional view of the second embodiment according present invention.

Referring to FIGS. 7 to 9, the second embodiment of the present invention is illustrated. It can be seen that the built-up container further includes:

A plurality of locating bars 28 are transversely disposed at the front and rear side plates 20 or the right and left side plates 30 in parallel with equal distances from each other and each of the locating bars 28 has a plurality of locating recesses 29 equally spacing apart from each other such that a plurality of flat partitions 40 are capable of insetting to the locating recesses 29 and dividing the space confined by the front and rear side plates 20 and the right and left side plates 30 into smaller rooms facilitating storage of various types tools.

As the foregoing, all fastening parts such as bolts for securing the front and rear side plates 20, the right and left side plates 30 and the upper cover plate 27 conceal inside the built-up container of the present invention instead of exposing outside the built-up container. Further, the integral structure of the built-in container is enhanced in addition to being assembled easily and fast and smooth and streamline appearance.

While the invention has been described with referencing to preferred embodiments thereof, it is to be understood that modifications or variations may be easily made without departing from the spirit of this invention, which is defined by the appended claims.

What is claimed is:

1. A built-up container, comprising:

a rectangular base;

front and rear side plates each having a lower joining part bent inward, the lower joining part being threadedly secured to the base, two side lip parts bent inward with a plurality of raised first threaded holes being lined up vertically next to each of the side lip parts, and a plurality of parallel, equally spaced locating bars formed on an inner surface of each of the front and rear side plate between the raised first threaded holes thereof, each of the locating bars having a plurality of equally spaced locating recesses;

a plurality of partition plates each being anchored between the opposite locating recesses;

right and left side plates each having a lower joining part bent inward, the lower joining part being threadedly secured to the base, and front and rear joining parts bent inward, each of the front and rear joining parts of either one of the right and left side plates having a plurality of second threaded holes aligned with the raised first threaded holes for being threadedly secured thereto to contain the front and rear ends of each of the right and left side plates in the side lip parts; and a cover hingedly secured to the rear side plate, wherein the threaded securements are not visible from outside the built-up container.

* * * * *